US009178299B2

(12) United States Patent
Alexia et al.

(10) Patent No.: US 9,178,299 B2
(45) Date of Patent: Nov. 3, 2015

(54) DEVICE COMPRISING AN ELECTRONIC CONNECTOR TO ESTABLISH A CONNECTION WITH AN ELECTRONIC DEVICE

(71) Applicant: DXO SA, Luxembourg (LU)

(72) Inventors: Jean-Marc Alexia, Alfortville (FR); Amaury Tremblay, Versailles (FR); Justin Michael Beck, Palo Alto, CA (US); Todd Elliot Lewis, Corvallis, OR (US); Tae In Um, Sunnyvale, CA (US); Daniel Zisuk Lee, Queensbury, NY (US)

(73) Assignee: DXO LABS SAS, Boulogne Billancourt (FR)

( * ) Notice: Subject to any disclaimer, the term of this patent is extended or adjusted under 35 U.S.C. 154(b) by 96 days.

(21) Appl. No.: 14/223,566

(22) Filed: Mar. 24, 2014

(65) Prior Publication Data

US 2015/0270636 A1 Sep. 24, 2015

(51) Int. Cl.

| | |
|---|---|
| ***H01R 13/60*** | (2006.01) |
| ***H01R 13/44*** | (2006.01) |
| ***H01R 13/56*** | (2006.01) |
| ***H01R 13/62*** | (2006.01) |

(52) U.S. Cl.
CPC ..... *H01R 13/44* (2013.01); *H01R 13/56* (2013.01); *H01R 13/62* (2013.01)

(58) Field of Classification Search
CPC ..... H01R 13/44; H01R 13/56; H01R 13/62
USPC ..... 439/534
See application file for complete search history.

(56) References Cited

U.S. PATENT DOCUMENTS

| | | | | |
|---|---|---|---|---|
| 5,781,232 A * | 7/1998 | Ejima | H04N 5/772 | 312/276 |
| 8,113,873 B1 * | 2/2012 | Sarraf | H01R 13/6315 | 439/533 |
| 8,721,356 B2 * | 5/2014 | Webb | G06F 1/1632 | 439/248 |
| 8,821,173 B2 * | 9/2014 | Carnevali | G06F 1/1632 | 361/679.41 |

* cited by examiner

*Primary Examiner* — Hien Vu
(74) *Attorney, Agent, or Firm* — Im IP Law PLLC; C. Andrew Im

(57) ABSTRACT

A device for establishing a connection with an electronic device comprises a connection device, a lever and a pedestal having a face comprises a latch having a degree of rotation with the pedestal. The connection device has one degree of rotation according to a first axis parallel to the face of the pedestal, and comprises the electronic connector and a concave relief. The lever is linked to the pedestal by a linkage comprising at least one degree of rotation according to a second axis parallel to the first axis of rotation. The lever comprises a convex relief corresponding to the concave relief of the connection device, and an elastic component adapted to maintain a contact between the lever and the pedestal. The lever is configured to enter in contact with the connection device after a rotation of the connection device enabled by the rotation of the latch.

10 Claims, 4 Drawing Sheets

DEVICE COMPRISING AN ELECTRONIC CONNECTOR TO ESTABLISH A CONNECTION WITH AN ELECTRONIC DEVICE

FIELD OF THE INVENTION

The present invention relates to a device comprising an electronic connector to establish a connection with an electronic device pertains to the field of mechanical connections between two devices. The present invention more particularly pertains to the field of mechanical connections between two devices when an electrical connection is involved.

BACKGROUND OF THE INVENTION

In the prior art, connections between electronic devices can usually be found by connecting a fixed male connector on one of the devices to a fixed female connector on the other device. However, when an important strain is applied, one of the devices breaks.

Retractable connectors can be found in the prior art, in USB sticks for example. The retraction can be done by translation or rotation and is adapted to put the connector in a position where the connector is protected from abnormal strains. However, when the connector reaches a final position, the connector will break when an abnormal strain is applied. Moreover, both devices can be damaged.

SUMMARY OF THE INVENTION

The present invention aims at solving the above-mentioned drawbacks that are present in the solutions of the prior art.

To this end, according to a first aspect, the present invention envisages a device comprising an electronic connector to establish a connection with an electronic device. The device comprises a pedestal having a face, a connection device and a lever. The pedestal comprises a latch having a degree of rotation with the pedestal. The connection device has one degree of rotation according to a first axis parallel to the face of the pedestal, and comprises the electronic connector and a concave relief. The lever is linked to the pedestal by a linkage comprising at least one degree of rotation according to a second axis parallel to the first axis of rotation. The lever comprises a convex relief corresponding to the concave relief of the connection device, elastic means adapted to maintain a contact between the lever and the pedestal, and configured to enter in contact with the connection device after a rotation of the connection device enabled by the rotation of the latch.

The present invention presents the advantages of having retractable connection device and therefore protects the electronic connector for abnormal strains in a retracted position. In addition to that, the fitting of the reliefs on the lever and the connection device can maintain itself in a position, called locked position, enabling a connection between the device and the electronic device.

Moreover, when the connection device is in a locked position and an abnormal strain is applied, the relief of the connection device can be dislodged from the relief of the lever thus releasing the electronic device without damaging either the device or the electronic device.

In embodiments of the invention, the pedestal comprises a ring and a carriage module, the carriage module having a least one degree of rotation with regards to the ring.

The rotation enables more freedom in the connection between an apparatus comprising the device and the electronic device. Moreover, when using the electronic device and the apparatus, the user can rotate the device and the apparatus in relation to each other. Also, the device may rotate when an abnormal strain is applied and prevent damages.

In embodiments of the invention, the convex relief is a right circular cone.

An advantage of these embodiments is that the connection device can be easily dislodged from the relief when an abnormal strain is applied. Also, in normal conditions of use, the position of the connection device is more stable.

In accordance with an embodiment of the claimed invention, the right circular cone comprises a fillet.

The fillet presents the advantages of having a more resistant relief and a smoother transition between the retracted position and the locked position.

In accordance with an embodiment of the claimed invention, the elastic means are a spring.

An advantage of the elastic means being a string is that the item is easily replaceable.

In accordance with an embodiment of the claimed invention, the elastic means are linked to the properties of the material of the lever.

The elastic means being linked to the material of the lever presents the advantage of having a lever independent from the quality of other items.

In accordance with an embodiment of the claimed invention, a coefficient of friction between the connection device and the lever is higher than 0.30.

The coefficient of friction between the connection device and the lever defines the strain to which the connection device can resist before being dislodged from the relief on the lever.

In accordance with an embodiment of the claimed invention, the pedestal comprises an obstacle preventing the connection device to rotate more than 180°.

Thanks to this provision, the connection device and more specifically the electronic connector are prevented from rotating excessively and being weakened upon encountering the pedestal.

In accordance with an embodiment of the claimed invention, the electronic connector is a male connector.

An advantage of having a male connector is enabling a connection with most electronic devices such as computers and mobile communication devices.

In accordance with an embodiment of the claimed invention, the face of the pedestal is planar.

A planar face of the pedestal enables a more stable connection to most devices and a diminished volume.

BRIEF DESCRIPTION OF THE DRAWINGS

Other advantages, aims and characteristics of the present invention will become apparent from the description that will follow, made, as an example that is in no way limiting, with reference to the drawings, in which.

DETAILED DESCRIPTION OF THE EMBODIMENTS

It should be noted that the drawings are not at scale.

Figure 1:
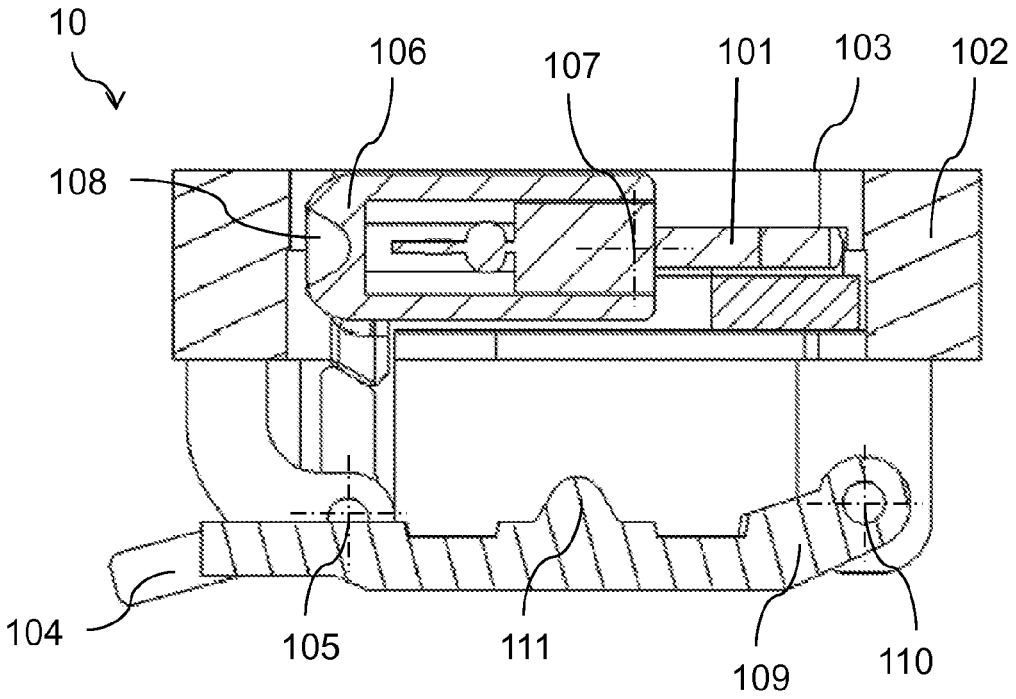
FIG. 1 represents, schematically, in a cross-section, a first particular embodiment of the device of the invention wherein the connection device in retracted position.

FIG. 1 shows a cross-section of an embodiment of the device 10.

In accordance with an exemplary embodiment of the claimed invention, the device 10 comprises a pedestal 102 comprising a face 103. The face 103 is preferentially planar. The face 103 may be the face from which an electronic connector 101 emerges when the electronic connector 101 is in locked position. Preferentially, when the connection device or connector 106 comprising the electronic connector 101 are in retracted position, none of the parts emerge from the face 103.

The top part of the pedestal 102 may be the part where the connection device 106 is stored while in retracted position. The top part of the pedestal 102 may have a circular shape.

In accordance with an exemplary embodiment of the claimed invention, the pedestal 102 may comprise a stop configured to prevent the connection device 106 from rotating excessively when being retracted. The stop may be parallel to the face 103. The stop may enter in contact with the electronic connector 101 when the connector 106 is being retracted. The stop may also be an obstacle preventing the connection device 106 to rotate more than 180°.

The pedestal 102 may comprise at least a hole configured to hold at least a shaft of the connection device 106. Preferentially, there are two holes having the same axis.

In accordance with an exemplary embodiment of the claimed invention, the pedestal 102 may comprise a ring 113 and a carriage module 112. The ring 113 and the carriage module 112 have one degree of rotation perpendicular to the face 103 of the pedestal 102.

In accordance with an exemplary embodiment of the claimed invention, the device 10 comprises the connection device 106 comprising an electronic connector 101 fixed with regards to the connection device 106. Preferentially the electronic connector 101 is a male connector. The electronic connector 101 may be, but is not limited to:

- a USB (universal serial bus) connector,
- a micro-USB connector,
- a lightning connector (Registered Trademark from Apple Inc.), or
- any kind of electronic connector.

The connection device 106 may have at least one degree of rotation with a carriage module of the pedestal 102. Preferentially, the connection device 106 rotate around one axis 107. The axis 107 may be parallel to the face 103 of the pedestal.

In accordance with an exemplary embodiment of the claimed invention, the connection device 106 may comprise at least one shaft configured to enable the rotation of the connection device 106 with regards to the pedestal 102 around the axis 107. Preferentially, there are two shafts placed into two holes of the pedestal 102 adjusted to configure a transition fit.

In accordance with an exemplary embodiment of the claimed invention, the connection device 106 comprises a concave relief 108. Preferentially, the relief 108 is a concave right circular cone comprising a fillet.

In accordance with an exemplary embodiment of the claimed invention, the connection device 106 may comprise a slanted stop. The slanted stop may be configured to maintain the connection device 106 in retracted position. The slanted stop may be in contact with the latch 104 when the connection device is in retracted position. The surface of the latch 104 may have a slant corresponding to the slant of the slanted stop.

In accordance with an exemplary embodiment of the claimed invention, the device 10 comprises a latch 104. The latch 104 may have at least one degree of rotation with the ring 113 of the pedestal 102. Preferentially, there is only one degree of rotation around an axis 105 parallel to the face 103. For example, a pivot joint is realized by fitting a shaft comprised by the latch 104 into a hole comprised by the pedestal 102.

In accordance with an exemplary embodiment of the claimed invention, the latch 104 may have the shape of an L, wherein one part of the L comprises a slanted edge configured to enter in contact with the connection device 106, and the other part of the L may be protruding and configured to be manipulated by a user in order release the connection device 106.

In accordance with an exemplary embodiment of the claimed invention, the device 10 comprises a lever 109. The lever 109 may have at least one degree of rotation with the ring 113 of the pedestal 102. Preferentially, there is only one degree of rotation around an axis 110 parallel the face 103. For example, a pivot joint is realized by fitting a shaft comprised by the lever 109 into a hole comprised by the pedestal 102.

In accordance with an exemplary embodiment of the claimed invention, the lever 109 may comprise a convex relief 111. Preferentially, the convex relief 111 of the lever 109 corresponds to the concave relief 108 on the connection device 106. Preferentially, the relief 111 is a convex right circular cone comprising a fillet.

The convex relief 111 and the concave relief 108 may have a coefficient of friction superior to 0.30.

In accordance with an exemplary embodiment of the claimed invention, the lever 109 comprises an elastic component or elastic means adapted to maintain a contact between the lever and the pedestal. The elastic component may be configured to facilitate the contact with the connection device 106 after a rotation of the connection device 106 enabled by the rotation of the latch 104. The elastic component may be a spring. In other embodiments, the elastic means may be linked to material properties of the lever 109.

The pedestal 102 is preferentially in stainless steel and may comprise a plastic part. The part of the connection device 106 not being the electronic connector 101 may be in plastic. The latch 104 may be in brass or plastic. The lever 109 may be in brass.

Figure 2:
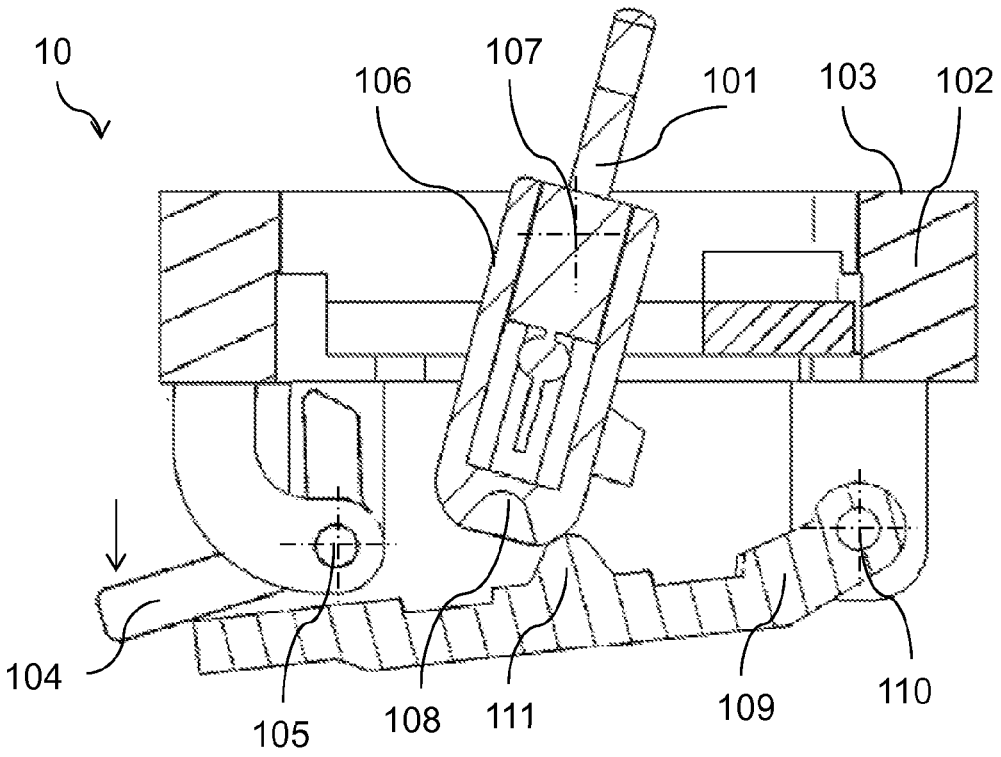
FIG. 2 represents, schematically, in a cross-section, a first particular embodiment of the device of the invention wherein the connection device in transitional position.
Figure 3:
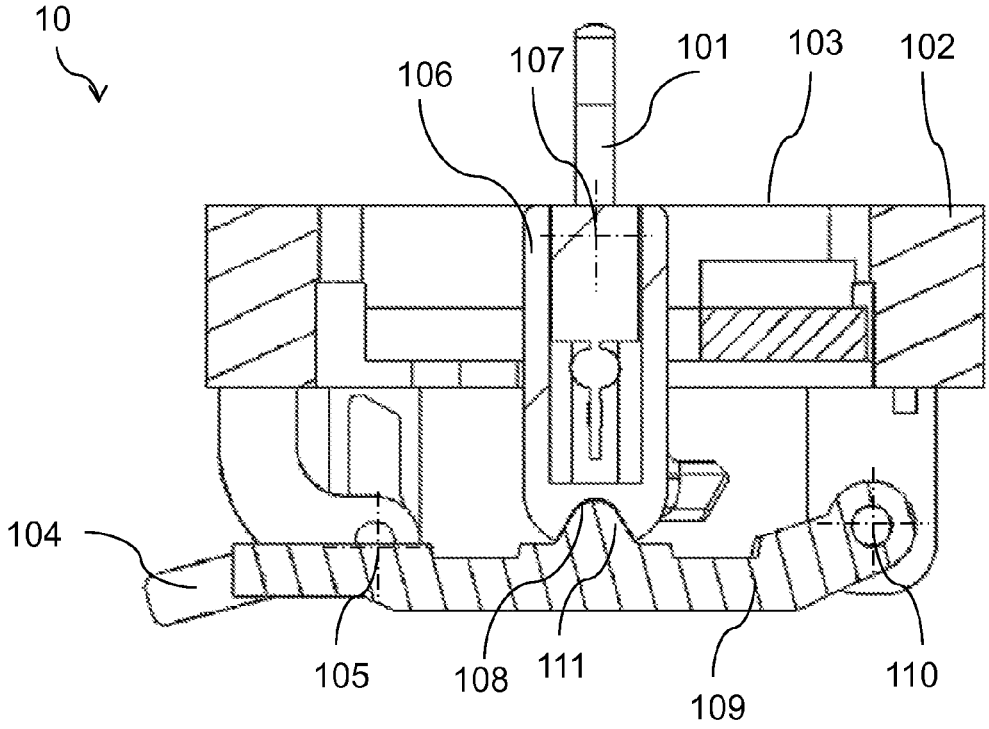
FIG. 3 represents, schematically, in a cross-section, a first particular embodiment of the device of the invention wherein the connection device in locked position.

FIGS. 1 to 3 describe the normal conditions of use of the device 10. In FIGS. 1 to 7, the device 10 corresponds to the embodiments of FIG. 1.

In normal conditions of use, the initial position of the device 10 is the retracted position as shown in FIG. 1. The retracted position may be defined as the position of the connection device 106 wherein a connection to an electronic device 401 is not possible. In retracted position, the slanted slope of the connection device 106 may be in contact with the slanted edge of the latch 104. The connection device 106 may be retracted and no part of the connection device 106 is protruding from the face 103 of the pedestal 102.

FIG. 2 represents the activation of the latch 104 that may rotate and liberate the contact between the slanted slope of the connection device 106 and the slanted edge of the latch 104. The latch 104 may also enter in contact with the lever 109 and rotate the lever away from the face 103 of the pedestal 102, therefore, the connection device 106 can rotate into a position in which it can be locked by fitting of the concave relief 108 and the convex relief 111.

FIG. 3 represents the connection device 106 in a locked position. The locked position may be defined as the position in which an electronic device 401 may be connected to the device 10. The locked position may be characterized by the fitting of the concave relief 108 on the connections device 106 and the convex relief 111 on the lever 109.

To retract the connection device 106, the steps described in FIGS. 1 to 3 may be carried out in reverse order.

Figure 4:
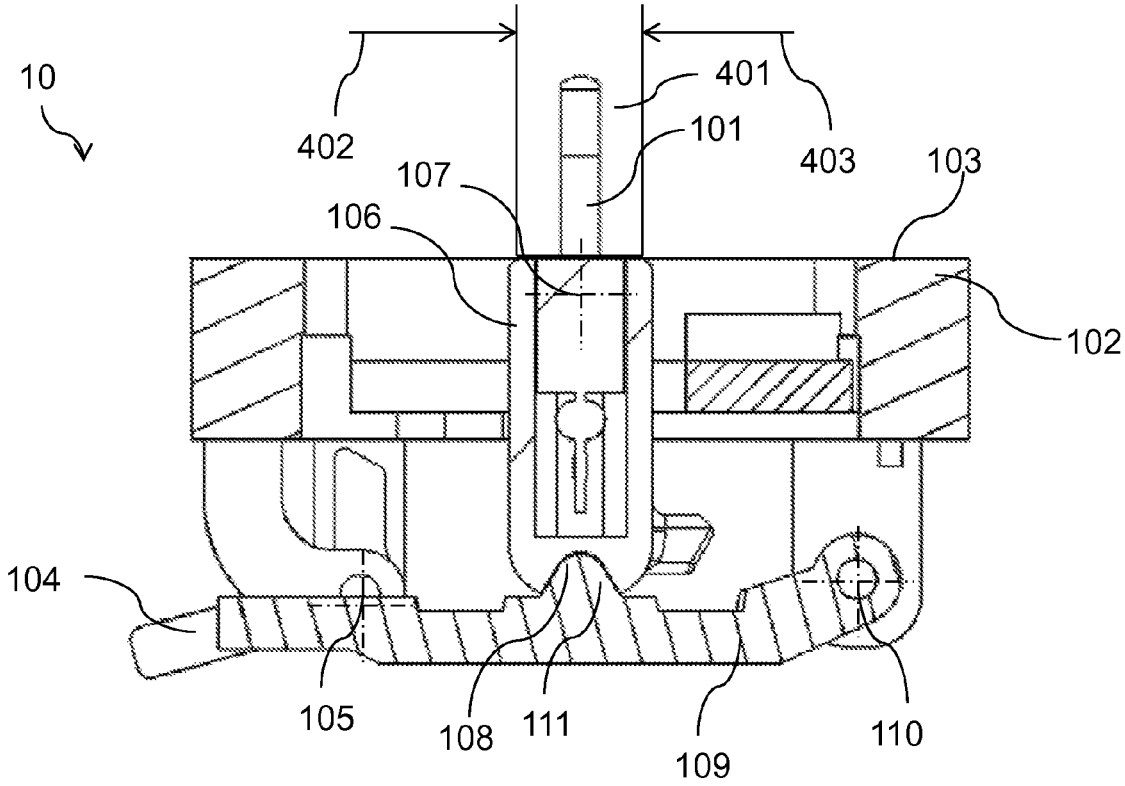
FIG. 4 represents, schematically, in a cross-section, a first particular embodiment of the device of the invention wherein the connection device in locked position connected to an electronic device.

FIG. 4 represents the connection of a device 10 with an electronic device 401. The electronic device 401 may include, but is not limited to:

a mobile communication device such as a smartphone, a tablet, a tablet computer, a computer, a telecommunication device, or any kind of device implementing electronic features.

The electronic device 401 has a width and may have two faces, that can be parallel for example, and a perpendicular face on which may be found an electronic connector. The electronic connector of the electronic device 401 is preferentially a female connector. The face are linked by edges. The electronic device 401 may be in contact with the face 103 of the device 10.

The electronic connector 101 of the device 10 is fitted with the electronic connector on the electronic device 401.

In abnormal conditions of use, a strain 402 may be applied to the electronic device 401 in a direction comprising a component perpendicular to the axis of rotation 107 between the connection device 106 and the pedestal 102. The direction of the strain 402 may be in a direction that would rotate the connection device 106 back into retracted position.

In other abnormal conditions of use, a strain 403 may be applied to the electronic device 401 in a direction comprising a component perpendicular to the axis of rotation 107 between the connection device 106 and the pedestal 102. The direction of the strain 403 may be in a direction that would rotate the connection device 106 away from the retracted position.

The relief 111 may have a symmetrical shape. Therefore, the electronic device 401 may resist to the same value of the strains 402 and 403. The resistance of the electronic device 401 may be due to the relief 111 and the coefficient of friction between the lever 109 and the connections device 106. The coefficient of friction is preferentially superior to 0.30. When the relief 111 is a right angle cone, the angle at the top of the relief 111 may modify the strain 402, 403 to which the connection device 106 can resist before being dislodged.

Figure 5:
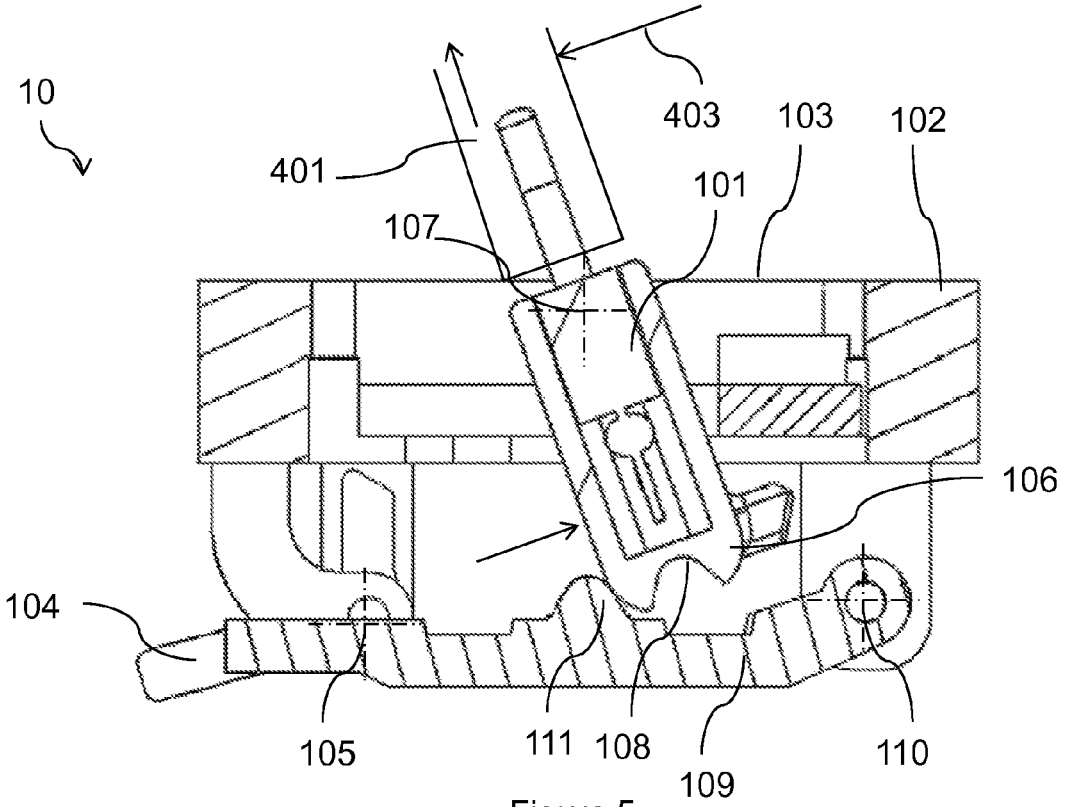
FIG. 5 represents, schematically, in a cross-section, a first particular embodiment of the device of the invention wherein the connection device dislodged with regards to a strain.

FIG. 5 represents the position of the device 10 once the strain 403 has become superior to the value of the strain the device 10 and/or the electronic 401 can resist or the strain 403 exceeds the strain threshold of the device 10 and/or the electronic device 401. As the strain 403 increases, the lever 109 may rotate away from the face 103 of the pedestal 102 releases the fitting of the concave relief 108 and the convex relief 111 up to a point where the connection device 106 is released on the side of the relief 111 closest to the rotation axis 110 of the lever 109. The elastic means may bring back the lever 109 into initial position.

Simultaneously, as the strain increases and the connection device 106 rotates, an edge of the electronic device 401 may enter in contact with the face 103 of the pedestal 102 and expel the electronic device 401. Therefore, as the strain increases, the electronic device 401 is released preventing the device 10 and the electronic device 401 from being damaged.

Figure 6:
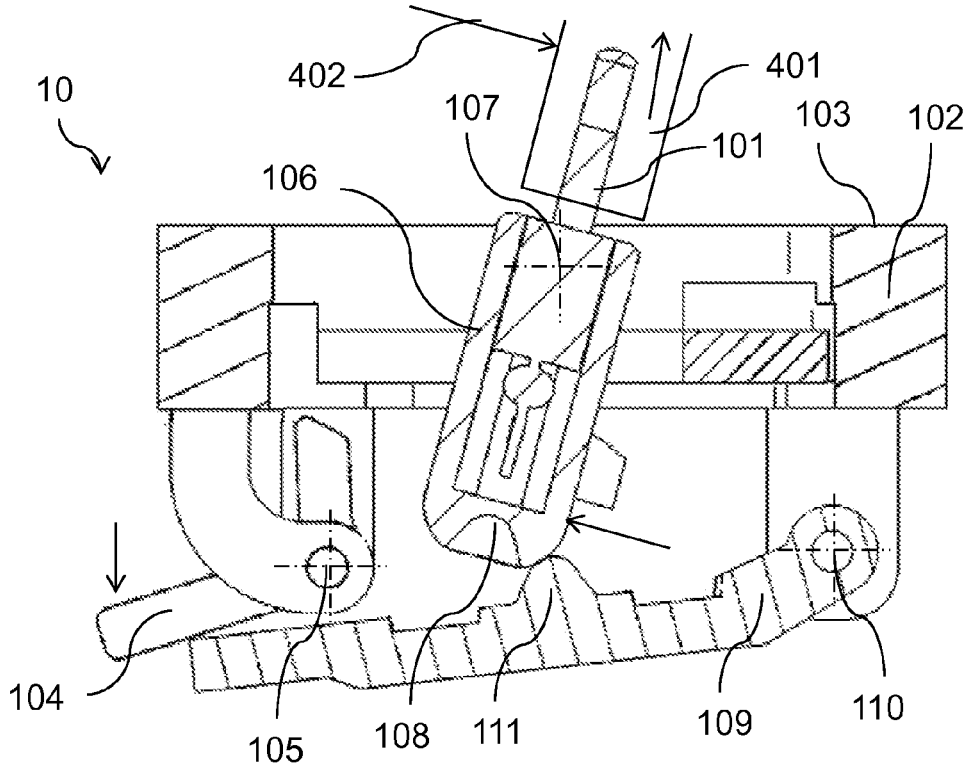
FIG. 6 represents, schematically, in a cross-section, a first particular embodiment of the device of the invention wherein the connection device dislodged with regards to another strain.

FIG. 6 represents the position of the device 10 once the strain 402 has become superior to the value of the strain the device 10 and/or electronic device 401 can resist or the strain 402 exceeds the strain threshold of the device 10 and/or the electronic device 401. As the strain 402 increases, the lever 109 may rotate away from the face 103 of the pedestal 102 thus releasing the fitting of the concave relief 108 and the convex relief 111 up to a point where the connection device 106 is released on the side of the relief 111 furthest to the rotation axis 110 of the lever 109. The elastic means may bring back the lever into initial position.

Simultaneously, as the strain increases and the connection device 106 rotates, an edge of the electronic device 401 may enter in contact with the face 103 of the pedestal 102 and expel the electronic device 401. Therefore, as the strain increases, the electronic device 401 is released preventing the device 10 and the electronic device 401 from being damaged.

Figure 7:
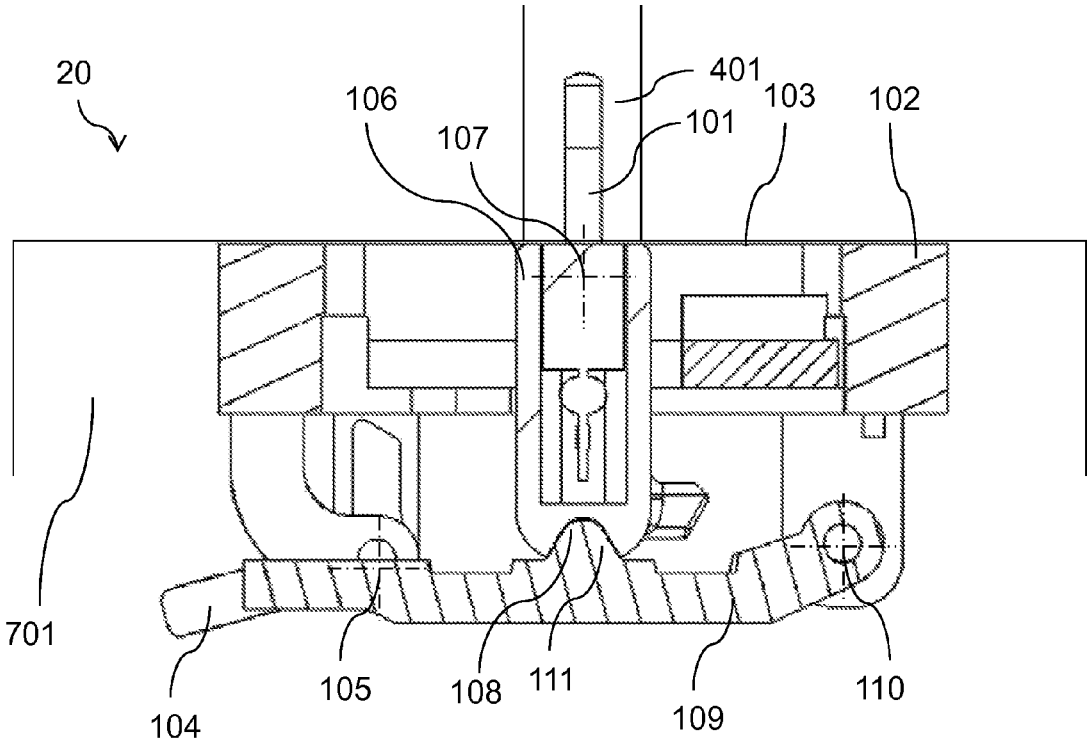
FIG. 7 represents, schematically, in a cross-section, a first particular embodiment of an apparatus comprising an embodiment of a device of the invention to an electronic device.

FIG. 7 represents, a particular embodiment of an apparatus 701 comprising a device 10 of the present invention connected to an electronic device 401.

The device 10 may be embedded in the apparatus so that the face 103 may not be protruding. In other embodiments the face 103 is protruding.

The apparatus 701 may include, but is not limited to:

a digital camera, a dock station, or any kind of device implementing electronic features.

In accordance with an exemplary embodiment of the claimed invention, the device 10 may have one at least one degree of rotation with regards to the apparatus 701. At least one degree of rotation is preferentially perpendicular to the face 103 of the pedestal 102.

Figure 8:
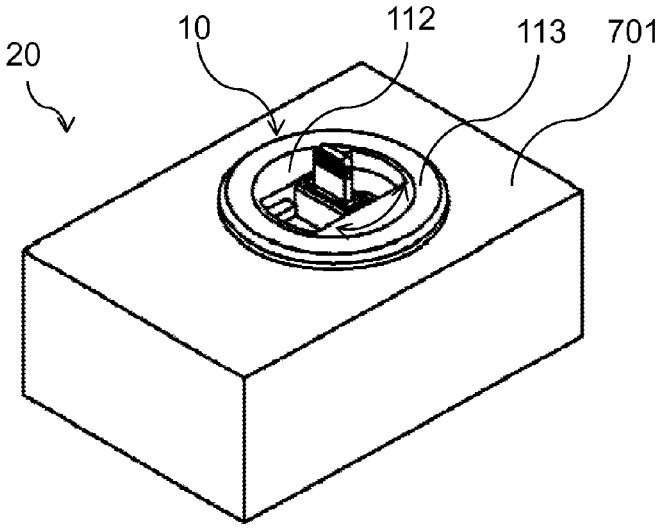
FIG. 8 represents, schematically, in perspective, a first particular embodiment of an apparatus comprising an embodiment of a device of the invention to an electronic device.

FIG. 8 represents, a particular embodiment of an apparatus 701 comprising a device 10 of the present invention.

In accordance with an exemplary embodiment of the claimed invention, the device 10 comprises a pedestal 102 comprising a ring 113 and a carriage module 112. The ring 113 and the carriage module 112 have one degree of rotation according to an axis perpendicular to the face 103 of the pedestal. The ring 113 may be fixed to the apparatus 701.

Preferentially, the connection device 106 may have at least one degree of rotation with the carriage module 112 of the pedestal 102. Preferentially, the connection device 106 rotate around one axis 107. The axis 107 may be parallel to the face 103 of the pedestal. Preferentially, there are two shafts on the connection device 106 placed into two holes of the carriage module of pedestal adjusted to configure a transition fit.

Preferentially, there is at least one degree of rotation, around an axis 105 parallel the face 103, between the latch 104 and the ring 113 of the pedestal. For example, a pivot joint is realized by fitting a shaft comprised by the latch 104 into a hole comprised by the ring 113 of the pedestal 102.

Preferentially, there is at least one degree of rotation, around an axis 110 parallel to the face 103, between the lever

109 and the ring 113 of the pedestal. For example, a pivot joint is realized by fitting a shaft comprised by the lever 109 into a hole comprised by the ring 113 of the pedestal 102.

The axes 107, 105 and 110 may be in planes parallel to the face 103 of the pedestal 102.

While the present invention has been particularly described with respect to the illustrated embodiment, it will be appreciated that various alterations, modifications and adaptations may be made based on the present disclosure, and are intended to be within the scope of the present invention. It is intended that the appended claims be interpreted as including the embodiment discussed above, those various alternatives which have been described and all equivalents thereto.

The invention claimed is:

1. A device for establishing a connection with an electronic device, comprising:

a pedestal comprising a carrier module, a flat surface at an upper end, and a latch at a lower end of the pedestal having a degree of rotation with the pedestal;

a connection device having one degree of rotation according to a first axis parallel to the flat surface of the pedestal, and comprising an electronic connector at one end and a concave relief at the other end;

a lever linked to other lower end of the pedestal by a linkage comprising at least one degree of rotation according to a second axis parallel to the first axis of rotation, and comprising:

a convex relief matching the concave relief of the connection device; and an elastic component adapted to maintain a contact between the lever and the pedestal; and wherein the lever is configured to enter in contact with the connection device after a rotation of the connection device enabled by the rotation of the latch.

2. The device according to claim 1, wherein the pedestal comprises a ring and the carriage module having a least one degree of rotation with regards to the ring.

3. The device according to claim 1, wherein the convex relief is a right circular cone.

4. The device according to claim 3, wherein the right circular cone comprises a fillet.

5. The device according to claim 1, wherein the elastic component is a spring.

6. The device according to claim 1, wherein the elastic component is linked to material properties of the lever.

7. The device according to claim 1, wherein a coefficient of friction between the connection device and the lever is higher than 0.30.

8. The device according to claim 1, wherein the pedestal comprises an obstacle to prevent the connection device from rotating more than 180°.

9. The device according to claim 1, wherein the electronic connector is a male connector.

10. The device according to claim 1, wherein the face of the pedestal is planar.

* * * * *